US005279229A

United States Patent [19]

Bredy et al.

[11] Patent Number: 5,279,229

[45] Date of Patent: Jan. 18, 1994

[54] AREA DEFENSE MINE

[75] Inventors: Thierry J. M. Bredy, Asnieres-les-Bourges; Emmanuel A. J. Marchand, Bourges, both of France

[73] Assignee: Giat Industries, Versailles, France

[21] Appl. No.: 955,971

[22] Filed: Oct. 2, 1992

[30] Foreign Application Priority Data

Oct. 2, 1991 [FR] France ..... 91 12099

[51] Int. Cl.[5] ..... F42B 23/16; F42B 23/24; F42C 14/08

[52] U.S. Cl. ..... 102/425; 102/404; 102/427

[58] Field of Search ..... 102/401, 404, 424, 425, 102/426, 427, 476

[56] References Cited

U.S. PATENT DOCUMENTS

| | | | |
|---|---|---|---|
| 3,994,227 | 11/1976 | Harvey | 102/404 |
| 4,232,605 | 11/1980 | Lair | 102/404 |
| 4,848,236 | 7/1989 | Hembise | 102/427 |
| 4,922,824 | 5/1990 | Schubert | 102/425 |
| 4,979,444 | 12/1990 | Schoffl | 102/401 |

FOREIGN PATENT DOCUMENTS

| | | |
|---|---|---|
| 3543769 | 5/1990 | Fed. Rep. of Germany . |
| 3904293 | 8/1990 | Fed. Rep. of Germany . |
| 2590973 | 6/1987 | France . |
| 2607585 | 6/1988 | France . |
| 2641071 | 6/1990 | France . |
| 2646232 | 10/1990 | France . |

*Primary Examiner*—David H. Brown
*Attorney, Agent, or Firm*—Oliff & Berridge

[57] ABSTRACT

An area defense mine has an orientable launch tube to fire a projectile at any bearing angle. The projectile contains at least one explosive charge, an arrangement for spinning the projectile about an axis of rotation and a device for detecting a target. The launch tube is orientable according to at least two different angles of sight. An arrangement for positioning the projectile in the launch tube allows the projectile to be positioned on a sabot of the tube in such fashion that the axis of rotation of the projectile remains oriented at a given axis whatever the angle of sight selected. Such a mine can be used either in a short-range or in a medium-range operating mode.

13 Claims, 2 Drawing Sheets

AREA DEFENSE MINE

BACKGROUND OF THE INVENTION

The present invention relates to an area defense mine of the type comprising an orientable launch tube to launch a projectile at some bearing angle and an observation system to detect a target in the effective area of the mine. The projectile contains at least one explosive charge, an arrangement for rotating the projectile around one axis thereof, and a target detection device.

In general, an area defense mine allows a target such as a tank to be attacked within a radius of a few tens to a few hundreds of meters, the radius sweeping a surface area corresponding to the effective area or operational range of the mine.

To attack a target, one generally envisages a mine with an omnidirectional or directional attack system.

In an omnidirectional attack system, a detection device carried on board the projectile sweeps the total effective area of the mine. The projectile is generally fired vertically and made to spin about a vertical axis so that the projectile detection device sweeps the ground in a spiral-shaped curve called a footprint. The mine is then used in the short-range operating mode, namely the radius of action of the mine is a few tens of meters.

A mine with an omnidirectional attack system is described in particular in document FR-2,641,071 which relates to a projectile self-propelled by an improved rocket engine.

In a directional attack system, the detection device carried on board the projectile sweeps only a sector of the effective area of the mine, so that the mine's observation system must first determine the bearing angle of the target in order for the projectile launch tube to be oriented at this angle. The projectile is generally fired at an angle of elevation between 45° and 60°. The projectile moves along a curved trajectory and its detection device sweeps the ground in a curve corresponding to the combination of a spiral and the projection onto the ground of the velocity vector of the projectile. In this case, the mine is used in a medium-range operating mode, i.e., the action radius of the mine is on the order of a few hundred meters.

A mine of this type is described in particular in document FR-2,607,585 where the projectile is self-propelled and made to spin about the roll axis, and in document FR-2,646,232 where the projectile is self-propelled and made to spin about an axis identical to the projectile launch axis.

SUMMARY OF THE INVENTION

A goal of the invention is to design a mine that can be used either in a short- or a medium-range operating mode.

For this purpose, the invention provides an area defense mine of the aforesaid type characterized by the launch tube being orientable at at least two different angles of sight, and by comprising a system for positioning the projectile in the launch tube so that the inclination of its axis of rotation relative to vertical is the same whatever the angle of sight selected.

BRIEF DESCRIPTION OF THE DRAWINGS

Other advantages, characteristics, and details of the invention will emerge from the explanatory description herein with reference to the attached drawings, provided solely as an example, wherein.

DETAILED DESCRIPTION OF PREFERRED EMBODIMENTS

Figure 1:
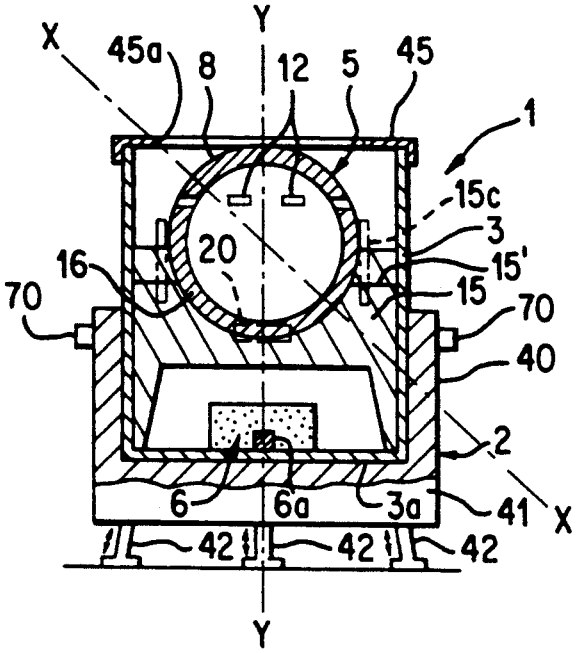
FIG. 1 is a schematic cross section of a mine according to the invention used in the short-range operating mode.

In general, in order for the mine according to the invention to be used in a short-range operating mode, one of the aforesaid angles of sight is approximately 90° such that the projectile is fired vertically. The other angle of sight is usually between 45° and 60°, the choice of this angle being determined by the projectile's own characteristics, particularly those of its explosive charge, to achieve an optimum trajectory. The explosive charge on board the projectile is usually a core generation charge.

According to another characteristic of the invention, the projectile's axis of rotation is preferably vertically oriented, and the firing axis of the explosive charge forms a predetermined angle a with this vertical axis.

In general, a mine according to the invention is placed on the ground by an operator who then chooses the short-range operating mode by orienting the launch tube vertically, or the medium-range operating mode by inclining the launch tube at a given angle of sight. For this purpose, the operator has a cylindrical platform in which the launch tube is accommodated. The platform rests on the ground by feet members which are height-adjustable to allow for an uneven ground surface.

According to the invention, as many platforms as angles of sight planned are provided. Alternatively, a single platform may be used which is equipped with an arrangement allowing the launch tube to be oriented at a given angle of sight and at a given bearing angle for the medium-range operating mode.

Once the launch tube is installed on the platform and stabilized on the ground by its feet, the operator fits the projectile inside the launch tube and, whatever the type of platform used, orients the projectile such that its axis of rotation is always aligned with a specific axis corresponding to the angle of sight selected. The projectile is oriented by a positioning device which is another characteristic of the invention.

According to one embodiment of the invention, the projectile has an envelope that has at least one part with a convex shape, and the launch tube contains a sabot whose upper surface has a central cavity with a concave shape complementary to the convex part of the projectile and which serves as a support surface for the projectile. The projectile positioning system, located at the interface between the projectile and the sabot, is composed of an indexing device associated with a locking device whose function is to lock the projectile to the sabot at the beginning of the projectile firing phase.

According to another embodiment of the invention, the sabot fitted into the launch tube is made of two parts, one of which receives the projectile. In this case, the positioning system is located at the interface between the two parts of the sabot.

In general, the indexing device of the system positioning the projectile on the sabot has a ball continuously urged by a spring to project into one of a plurality of recesses whose number is equal to that of the possible angles of sight, and the device locking the projectile to the sabot has weights whose number is equal to that of the aforementioned recesses. One of these weights is opposite yet another recess in the sabot for each given angle of sight before partially engaging itself therein during the projectile firing phase.

According to yet another characteristic of the invention, the projectile is ejected by gas pressure resulting from combustion of a propulsive charge ignited in the launch tube. Rotation of the projectile around a vertical axis is achieved by pyrotechnic thrusters carried on board the projectile and disposed in a crown centered on its axis of rotation.

Thus, according to one important advantage of the invention, a given projectile can be used either in a short- or a medium-range operating mode, which facilitates in particular manufacturing, maintenance, and logistical operations.

Area defense mine 1, as shown schematically in FIG. 1, has a platform 2 f or resting on the ground, a launch tube 3 supported by platform 2, and a projectile 5 fitted into tube 3 in order to be fired to attack a target located in the effective area of mine 1. Projectile 5 is ejected from launch tube 3 by means of a propulsive charge 6 located at the bottom of tube 3.

Figure 2:
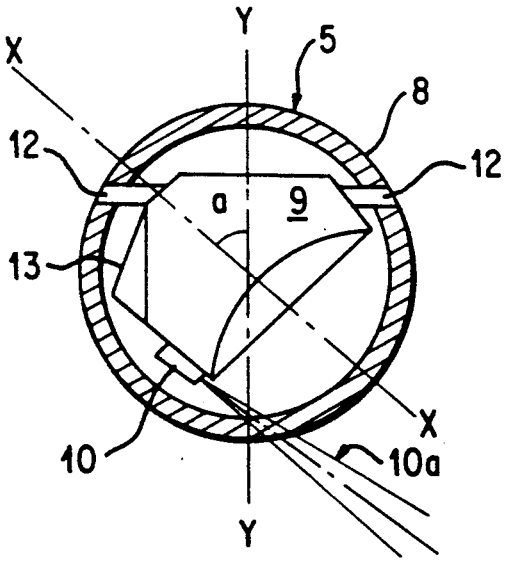
FIG. 2 is a schematic cross section of the projectile of the mine.

In the example illustrated in FIGS. 1 and 2, projectile 5 comprises a spherical envelope 8 inside which the following in particular are accommodated (FIG. 2):

- an explosive charge 9, in particular a core generation charge CGN fired along a predetermined axis XX making an angle a with the vertical indicated by a vertical axis YY;
- detection means 10, of the IR or millimeter type for example, in the active or passive mode, which generates a beam 10*a* which is essentially parallel to the firing axis XX of charge 9;
- a plurality of pyrotechnic thrusters 12, of the powder type for example, located on a crown centered on axis YY, and which are oriented such as to cause projectile 5 to spin about a predetermined axis, for example vertical axis YY; and
- a power source and processing and command electronics designated by the general reference numeral 13.

In general, pyrotechnic thrusters 12 are commanded after a given time lag by a safety and priming device of the classical type. This device, built into the processing and command unit 13, is itself activated by the firing of projectile 5. Envelope 8 of projectile 5 is made of at least two parts to accommodate all the aforesaid elements. The means for attaching the two parts together are not shown.

Projectile 5 rests on a sabot 15 accommodated inside launch tube 3. This sabot 15 rests on the bottom wall 3*a* of tube 3, and at its upper surface has a central cavity 16 having the complementary shape of a spherical cap of envelope 8 and which serves as a support surface for projectile 5. To stabilize projectile 5 on sabot 15, cavity 16 is sufficiently deep for projectile 5 to fit in up to near its equatorial plane for example.

Figure 3:
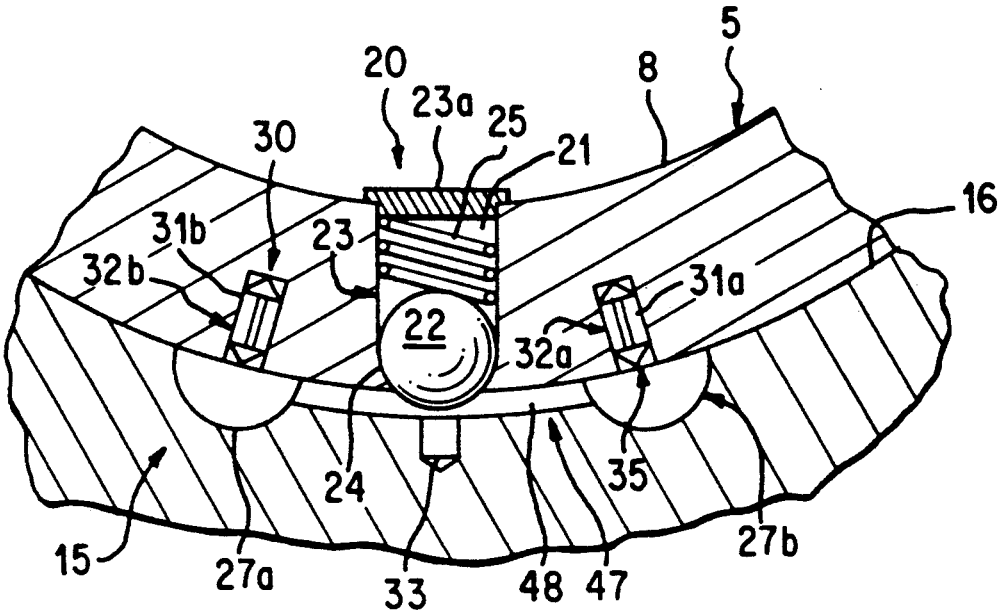
FIG. 3 is a cross section on a large scale of the positioning system of the mine inside the launch tube.

With reference to FIG. 3, projectile 5 is installed on sabot 15 by means of a positioning system 20 which allows the axis of rotation of projectile 5 to be oriented according to vertical axis YY, whereby firing axis XX of charge 9 makes an angle a relative to this vertical axis YY. In the example considered here, positioning system 20 is located at the interface between projectile 5 and sabot 15, and comprises an indexing device 21 associated with a locking device 30 whose function is to lock projectile 5 relative to sabot 15 at the beginning of the firing phase of projectile 5.

Indexing device 21 has an element such as a ball 22 which is received freely in an external radial recess 23 of envelope 8 of projectile 5. Recess 23 has, near its end projecting outward, a frustoconical support 24 to hold ball 22 while allowing it to project partly outside envelope 8 under the permanent urging of a spring 25 fitted into the bottom of recess 23. Of course, recess 23 is formed after an orifice has been made in envelope 8 to allow frustoconical support 24 to be machined. The internal aperture of the orifice is then closed by a plug 23*a*.

The part of ball 22 that can project outside envelope 8 of projectile 5 is designed to be received in one of several complementary recesses provided at the surface of cavity 16 of sabot 15. There are the same number of recesses as possible positions of projectile 5 relative to sabot 15. In the example considered in FIG. 3, two recesses 27*a* and 27*b* are shown, which correspond respectively to two possible firing directions of projectile 5.

Guide means 47 may advantageously be provided, allowing relative rotation of projectile 5 relative to sabot 15 on an axis perpendicular to the vertical plane passing through both recesses 27*a* and 27*b* (namely the vertical plane passing through the two possible firing directions of the projectile) to facilitate relative positioning of projectile 5 with respect to sabot 15. These guide means 47 are for example a groove 48 with a circular bottom provided at the surface of cavity 16 of sabot 15, connecting the two recesses 27*a* and 27*b* with each other. This groove 48 will receive and guide ball 22 when it passes from one recess to the other.

Device 30, for immobilizing projectile 5 relative to sabot 15, has two weights 31*a* and 31*b* mounted respectively in two outer radial recesses 32*a* and 32*b* of envelope 8 of projectile 5. These two recesses 32*a* and 32*b* are located one on either side of recess 23 of ball 22. A radial recess 33 that matches recesses 32*a* and 32*b* is provided at the surface of cavity 16 between the two recesses 27*a* and 27*b*. This recess 33 is aligned with the firing direction of projectile 5, namely, it is located on the axis of launch tube 3. Depending on whether ball 22 is received in recess 27*a* or 27*b*, recess 33 is located opposite weight 31*a* or 31*b*, respectively. Each recess 32*a* and 32*b* is closed by an element 35, such as a metal foil for example, to hold the associated weight as long as projectile 5 remains static.

In the short-range operating mode (FIG. 1), launch tube 3 must be oriented vertically along axis YY. For this purpose, the operator responsible for placing mine 1 on the ground uses a platform 2 such as a hollow cylindrical body 40 having a bottom wall 41 and support feet 42 which are height-adjustable to allow for an uneven ground surface. Once platform 2 has been positioned vertically, the operator introduces launch tube 3 into body 40 of platform 2 and then positions projectile 5 inside tube 3, orienting it such that ball 22 of positioning system 20 projects into recess 27a of sabot 15. Projectile 5 is then in the position in FIG. 2. Finally, the operator slips a lid 45 over the outlet opening of launch tube 3. Lid 45, attached by any classical means to tube 3, has a central opening 45a whose diameter is larger than that of envelope 8 of projectile 5. The function of this lid 45 is to hold sabot 15 during the firing phase without preventing ejection of projectile 5.

When mine observation system 70 (system of a known type, for example acoustic or magnetic) has detected a target in the effective area of the mine, projectile 5 is fired. This is done by the propulsive charge 6 of launch tube 3 being triggered by an igniter 6a. The gas pressure resulting from the burning of charge 6 causes simultaneous ejection of sabot 15 and projectile 5 along vertical axis YY.

The force received by sabot 15 upon firing is such that weight 31a opposite recess 33 of sabot 15 perforates thin metal foil 35 which had held it in its recess 32a. Weight 31a then engages recess 33 of sabot 15, so that projectile 5 can be locked to sabot 15. It is mechanically advantageous for weights 31a and 31b to be made of steel so that they have a certain weight, and for recess 33 of sabot 15 to have a size such that the weights can be forced into them. On leaving launch tube 3, sabot 15 is held by lid 45 and projectile 5 is separated from sabot 15 by the aerodynamic effect. Weight 31a, jammed into recess 33 of sabot 15, facilitates this separation.

At the end of this propulsion phase, projectile control electronics 13 cause pyrotechnical thrusters 12 to be fired, causing projectile 5 to spin around vertical axis YY. Detection beam 10a sweeps the ground in a spiral-shaped footprint, and as soon as the target is detected, charge 9 is fired along axis XX.

In a medium-range operating mode (FIG. 4), launch tube 3 is oriented according to a given angle of sight. In this case, the operator who places mine 1 on the ground uses another platform 2 comprising a hollow cylindrical body 50 inclined at the aforesaid angle of sight, and which has a bottom wall 51. Body 50 is mounted such that it can rotate about a vertical axis A on a horizontal plate 52 which rests on the ground by height-adjustable feet 53. The operator positions platform 2 on the ground and adjusts the level of plate 52 by adjusting the height of each foot 53 individually; plate 52 may incorporate a level 55, for example, to facilitate adjustment. The operator places launch tube 3 in body 50 and then positions projectile 5 inside tube 3 such that ball 22 of positioning system 20 is partially received in recess 27b of sabot 15. At this time, weight 31b of locking device 30 is then opposite recess 33 of sabot 15. Projectile 5 is then in the same position as before (FIG. 2), namely its axis of rotation is still oriented in the vertical direction indicated by axis YY.

When the observation system 70 of mine 1 has detected a target in the effective area of the mine, it calculates the bearing angle of the target and commands body 50 to rotate on plate 52 of platform 2 by motor means, for example a stepping motor (not shown), to orient launch tube 3 according to the previously calculated bearing angle. The projectile is then fired as before, with pyrotechnic thrusters 12 being fired to give it a rotational movement along vertical axis YY, namely along an axis different from that of the velocity vector. As soon as detection beam 10a has detected the target, charge 9 is fired along axis XX.

Figure 5:
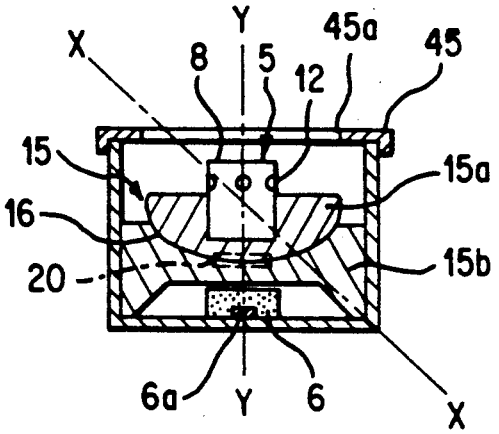
FIG. 5 is a view in schematic cross section of a mine according to the invention according to one embodiment.
Figure 6:
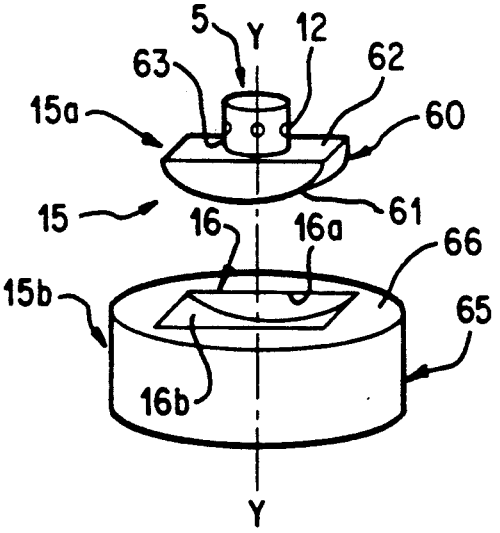
FIG. 6 is an exploded perspective view of the mine shown in FIG. 5 and limited to the projectile and its support.

According to another embodiment shown in FIGS. 5 and 6, sabot 15 is composed of two parts, 15a and 15b.

First part 15a of sabot 15 is composed of a body 60 with a convex bottom wall 61 whose face 62 opposite this bottom wall 61 is rectangular in shape. A central recess 63 is provided in face 62 of body 60 to receive a portion of projectile 5. In this embodiment, projectile 5 has a cylindrical envelope 8 and is held in recess 63 by, for example, an adhesive.

Second part 15b of the sabot is composed of a cylindrical body 65 which rests on the bottom of launch tube 3. Upper face 66 of body 65 has a central cavity 16 with a rectangular opening 16a and a bottom wall 16b whose shape matches that of bottom wall 61 of body 60 of first part 15a of the sabot to receive the latter.

In this second embodiment, positioning system 20, which allows projectile 5 to be oriented relative to sabot 15, is of the same type as that described previously, and is mounted at the interface between the two parts 15a and 15b of sabot 15. In this case, however, it is not necessary to provide a guide means for ball 22 to pass from recess 27a to recess 27b and vice versa. In this embodiment, the guide means is constituted by the rectangular shape of cavity 16 of body 65.

Figure 4:
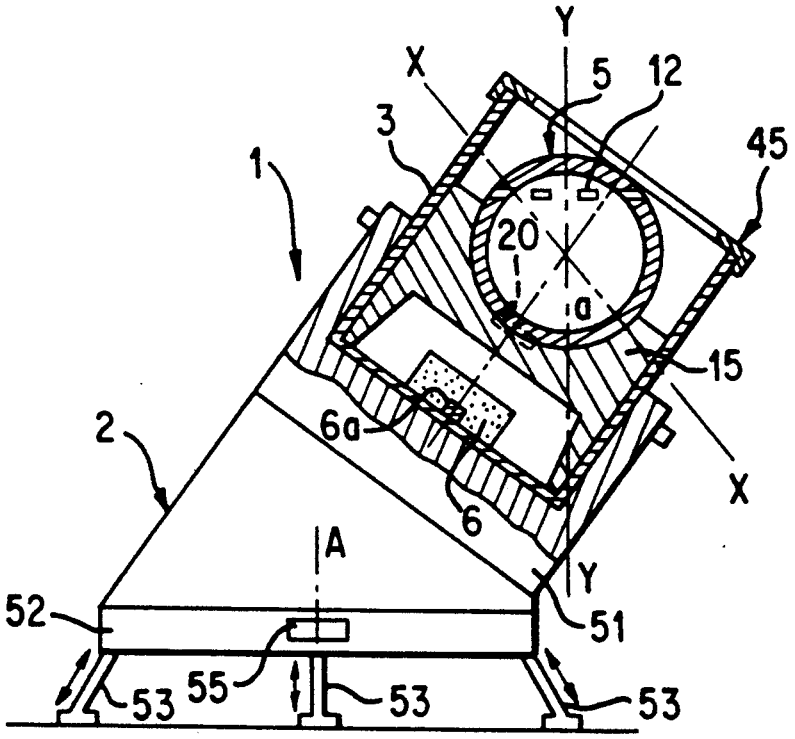
FIG. 4 is a view in schematic cross section of a mine according to the invention used in the medium-range operating mode.

Platform 2 is used for both the FIG. 1 embodiment for a short-range operating mode and the FIG. 4 embodiment for a medium-range operating mode. When projectile 5 is fired, body 65 is held by lid 45 of launch tube 3, and projectile 5 separates automatically from body 65 because of the aerodynamic forces generated.

In general, it is possible to envisage alternative embodiments, some of which are listed below:

- projectile 5 could be ejected from launch tube 3 by a thruster integral with sabot 15;
- thrusters 12 used for spinning the projectile can be explosive thrusters of the type described in document FR-2,590,973;
- ball 22 of device 20 which positions projectile 5 on sabot 15 can be carried by projectile 5 or by sabot 15, whereby recess 33 of sabot 15 designed to receive one of weights 31a or 31b is preferably aligned with the axis of the tube in order not to impede separation of the sabot from the projectile on leaving launch tube 3;
- in the case where the depth of cavity 16 of sabot 15 is insufficient to ensure good stability of projectile 5, a retaining ring 15c projecting at surface 15' of sabot 15 may be provided, as shown in dashed lines in FIG. 1, so that projectile 5 can spin once its orientation has been chosen, but is prevented from tilting;
- in the second embodiment where sabot 15 is in two parts 15a and 15b, their contact surfaces could be spherical, in which case it is advantageous to provide guide means to cause projectile 5 to pass from one angle of sight to the other;
- still in this second embodiment where projectile 5 has a cylindrical shape, it is possible for its axis of symmetry to be inclined relative to its axis of rotation;
- it is possible to envisage a single platform 2 which could allow launch tube 3 to be oriented vertically or at least at one given angle of sight, as desired;
- envelope 8 of the projectile is not necessarily spherical or cylindrical; it may be hemispherical or ellipsoidal for example;

finally, it is possible to design a mine in which there are two possible positions for projectile 5 relative to sabot 15, and hence more than two different angles of sight for one and the same mine.

Although the invention has been described in detail including the list of alternative embodiments above, it is not meant to be limited thereto. Rather, various modifications may become apparent to those skilled in the art (in particular as regards positioning system 21 for keeping the rotational axis of projectile 5 oriented according to a given axis) without departing from the spirit and scope of the present invention as defined in the following claims.

What is claimed is:

1. An area defense mine comprising:

a launch tube orientable according to at least two different angles of sight;

means for monitoring an effective area of the mine to detect a target;

a projectile comprising at least one explosive charge, means for rotating the projectile around at least one axis thereof, and at least one target detector; and means for positioning said projectile in said launch tube such that an inclination of its axis of rotation relative to vertical is the same regardless of the angle of sight selected.

2. The area defense mine according to claim 1, wherein said launch tube is orientable at an angle of sight of approximately 90°, corresponding to a short-range operating mode, and at at least one angle of sight corresponding to a medium-range operating mode.

3. The area defense mine according to claim 2, wherein said at least one angle of sight is between 45° and 60°.

4. The area defense mine according to claim 1, wherein said launch tube is oriented at two angles of sight by using two different platforms.

5. The area defense mine according to claim 4, wherein said two angles of sight are 45° and 60°.

6. The area defense mine according to claim 1, wherein said launch tube comprises a sabot having a central cavity forming a support surface for said projectile.

7. The area defense mine according to claim 6, wherein said sabot comprises first and second parts, said first part being arranged to support said projectile, and wherein said positioning means is located at an interface between said first and second parts.

8. The area defense mine according to claim 7, wherein said first part of said sabot is composed of a body having a bottom wall of convex shape and a central recess having a rectangular face opposite said bottom wall to receive a part of said projectile.

9. The area defense mine according to claim 8, wherein said second part of said sabot is composed of a cylindrical body resting on a bottom surface of said launch tube, and a central cavity located at an upper face of said cylindrical body, said central cavity having an opening and a bottom wall with a shape matching that of said bottom wall of said first part of said sabot.

10. The area defense mine according to claim 6, wherein said means for positioning said projectile comprises indexing means for orienting said projectile according to an angle of sight desired and means for locking said projectile relative to said sabot during firing of said projectile.

11. The area defense mine according to claim 10, wherein said indexing device comprises a ball continuously urged by a spring to partially project into one of a plurality of recesses in said sabot, each of said recesses corresponding to a given angle of sight.

12. The area defense mine according to claim 11, wherein said means for locking said projectile relative to said sabot comprises a plurality of weights and an additional recess in said sabot to receive one of said weights during firing of the projectile, one of said weights being opposite said additional recess for each angle of sight.

13. The area defense mine according to claim 12, wherein said positioning system further comprises guide means for guiding said ball to pass from one of said recesses in said sabot to another of said recesses in said sabot.

* * * * *